US010669843B2

(12) United States Patent
Turner

(10) Patent No.: US 10,669,843 B2
(45) Date of Patent: Jun. 2, 2020

(54) DUAL ROTOR PULSER FOR TRANSMITTING INFORMATION IN A DRILLING SYSTEM

(71) Applicant: APS Technology, Inc., Wallingford, CT (US)

(72) Inventor: William Evans Turner, Wallingford, CT (US)

(73) Assignee: APS Technology, Inc., Wallingford, CT (US)

( * ) Notice: Subject to any disclaimer, the term of this patent is extended or adjusted under 35 U.S.C. 154(b) by 0 days.

(21) Appl. No.: 16/402,842

(22) Filed: May 3, 2019

(65) Prior Publication Data

US 2019/0264558 A1 Aug. 29, 2019

Related U.S. Application Data

(62) Division of application No. 15/433,412, filed on Feb. 15, 2017, now Pat. No. 10,323,511.

(51) Int. Cl.
*E21B 47/18* (2012.01)

(52) U.S. Cl.
CPC ..... *E21B 47/182* (2013.01)

(58) Field of Classification Search
CPC ..... E21B 47/182; E21B 47/18
USPC ..... 367/83–84; 175/48
See application file for complete search history.

(56) References Cited

U.S. PATENT DOCUMENTS 2,901,685 A * 8/1959 Alder ..... G01V 1/52 323/354
2,964,116 A * 12/1960 Peterson ..... E21B 47/18 175/48
2,973,505 A * 2/1961 Johannesen ..... G01V 3/34 340/854.4
3,065,416 A * 11/1962 Jeter ..... E21B 4/02 175/40
3,302,457 A * 2/1967 Mayes ..... E21B 21/08 367/83
3,309,656 A * 3/1967 Godbey ..... E21B 47/185 367/85
3,713,089 A * 1/1973 Clacomb ..... E21B 47/18 367/84
3,732,728 A * 5/1973 Fitzpatrick ..... E21B 47/06 340/854.4
3,736,558 A * 5/1973 Cubberly, Jr. ..... E21B 47/18 367/85
3,737,843 A * 6/1973 Le Peuvedic ..... E21B 47/18 367/85
3,739,331 A * 6/1973 Godbey ..... E21B 47/18 367/142

(Continued)

*Primary Examiner* — Albert K Wong
(74) *Attorney, Agent, or Firm* — Offit Kurman, P.C.; Gregory A. Grissett

(57) ABSTRACT

A rotary pulser for transmitting information in a mud pulse telemetry system of a drilling operation. The pulser has two rotors mounted adjacent each other so that obstruction of the passages formed between the blades in one pulser by the blades of the other pulser creates pressure pulses in the drilling fluid. Each rotor is separately controlled and can be rotated continuously in one direction or oscillated. The ability to rotate each rotor separately provides flexibility in the pulser's operating mode, so as to allow more efficient generation of pulses, and also enhances the ability of the pulser to clear debris that would otherwise jam or obstruct the pulser.

9 Claims, 6 Drawing Sheets

(56) References Cited

U.S. PATENT DOCUMENTS 3,742,443 A * 6/1973 Foster ..... E21B 47/18 367/83
RE30,055 E * 7/1979 Claycomb ..... E21B 41/0085 367/84
4,351,037 A * 9/1982 Scherbatskoy ..... E21B 41/0085 175/40
4,462,469 A * 7/1984 Brown ..... E21B 4/00 175/107
4,499,563 A * 2/1985 Jurgens ..... E21B 47/18 367/84
4,585,401 A * 4/1986 Baldenko ..... E21B 4/02 418/5
4,628,495 A * 12/1986 Peppers ..... E21B 47/18 175/40
4,630,244 A * 12/1986 Larronde ..... E21B 47/18 367/84
RE32,463 E * 7/1987 Westlake ..... E21B 47/185 175/48
4,698,794 A * 10/1987 Kruger ..... E21B 4/02 367/81
4,734,892 A * 3/1988 Kotlyar ..... E21B 47/182 175/40
4,785,300 A * 11/1988 Chin ..... E21B 47/18 137/499
4,790,393 A * 12/1988 Larronde ..... E21B 47/18 175/40
4,796,699 A * 1/1989 Upchurch ..... E21B 23/04 166/250.17
4,847,815 A * 7/1989 Malone ..... E21B 47/18 367/84
4,914,637 A * 4/1990 Goodsman ..... E21B 47/18 367/83
4,915,168 A * 4/1990 Upchurch ..... E21B 23/04 166/250.15
4,956,823 A * 9/1990 Russell ..... E21B 47/182 367/84
4,992,997 A * 2/1991 Bseisu ..... E21B 47/16 181/106
5,073,877 A * 12/1991 Jeter ..... E21B 47/18 367/84
5,079,750 A * 1/1992 Scherbatskoy ..... E21B 41/0085 367/83
5,113,379 A * 5/1992 Scherbatskoy ..... E21B 41/0085 367/83
5,119,344 A * 6/1992 Innes ..... E21B 47/182 367/84
5,182,731 A * 1/1993 Hoelscher ..... E21B 47/18 367/84
5,189,645 A * 2/1993 Innes ..... E21B 47/18 367/84
5,215,152 A * 6/1993 Duckworth ..... E21B 47/18 175/48
5,357,483 A * 10/1994 Innes ..... E21B 47/18 367/84
5,517,464 A * 5/1996 Lerner ..... E21B 41/0085 367/84
5,586,083 A * 12/1996 Chin ..... E21B 47/18 367/84
5,586,084 A * 12/1996 Barron ..... G01V 1/52 367/85
5,636,178 A * 6/1997 Ritter ..... E21B 47/18 367/83
5,692,712 A * 12/1997 Weinschenk, Jr. ..... A47B 21/0314 248/118
5,787,052 A * 7/1998 Gardner ..... E21B 47/18 175/48
6,105,690 A * 8/2000 Biglin, Jr. ..... E21B 47/18 166/250.01
6,219,301 B1 * 4/2001 Moriarty ..... E21B 47/182 367/84
6,244,844 B1 * 6/2001 Diaz ..... F01C 1/084 418/201.3
6,289,998 B1 * 9/2001 Krueger ..... E21B 7/18 175/107
6,469,637 B1 * 10/2002 Seyler ..... E21B 47/187 181/102
6,714,138 B1 * 3/2004 Turner ..... E21B 47/18 340/854.3
7,997,380 B2 * 8/2011 Arian ..... G01V 1/523 181/102
9,540,926 B2 * 1/2017 Perry ..... E21B 47/182
10,323,511 B2 * 6/2019 Turner ..... E21B 47/182
2003/0183388 A1 * 10/2003 Toulouse ..... E21B 4/02 166/298
2006/0215491 A1 * 9/2006 Hall ..... E21B 47/18 367/83
2006/0283632 A1 * 12/2006 Hall ..... E21B 7/04 175/26
2007/0182583 A1 * 8/2007 Feluch ..... E21B 47/187 340/855.4
2010/0230113 A1 * 9/2010 Hutin ..... E21B 47/182 166/373
2012/0199344 A1 * 8/2012 McGarian ..... E21B 7/061 166/250.11
2012/0211251 A1 * 8/2012 Konschuh ..... E21B 28/00 173/201
2013/0105221 A1 * 5/2013 Wassell ..... E21B 44/00 175/40
2014/0124693 A1 * 5/2014 Gopalan ..... E21B 47/182 251/359
2015/0233237 A1 * 8/2015 Logan ..... E21B 47/18 367/84
2015/0247403 A1 * 9/2015 Logan ..... E21B 47/18 175/40
2015/0292322 A1 * 10/2015 Logan ..... E21B 47/18 166/330

* cited by examiner

DUAL ROTOR PULSER FOR TRANSMITTING INFORMATION IN A DRILLING SYSTEM

CROSS-REFERENCE TO RELATED APPLICATIONS

The present application is a divisional application of U.S. application Ser. No. 15/433,412, filed Feb. 15, 2017, entitled Dual Rotor Pulser For Transmitting Information, the entire contents of which are incorporated by reference into the present application.

TECHNICAL FIELD

The present disclosure is directed to an improved dual rotor pulser for transmitting information in a drilling system, such as a rotator pulser used in a mud pulse telemetry system employed in a drill string for drilling an oil well.

BACKGROUND

In underground drilling, such as gas, oil or geothermal drilling, a bore is drilled through a formation deep in the earth. Such bores are formed by connecting a drill bit to sections of long pipe, referred to as a "drill pipe," so as to form an assembly commonly referred to as a "drill string" that extends from the surface to the bottom of the bore. The drill bit is rotated so that it advances into the earth, thereby forming the bore. In rotary drilling, the drill bit is rotated by rotating the drill string and/or the drill bit. In order to lubricate the drill bit and flush cuttings from its path, pumps on the surface pump a high pressure fluid, referred to as "drilling mud," through an internal passage in the drill string and out through the drill bit. The drilling mud then flows to the surface through the annular passage formed between the drill string and the surface of the bore.

Depending on the drilling operation, the pressure of the drilling mud flowing through the drill string will typically be between 1,000 and 25,000 psi. In addition, there is a large pressure drop at the drill bit so that the pressure of the drilling mud flowing outside the drill string is considerably less than that flowing inside the drill string. Thus, the components within the drill string are subject to large pressure forces. In addition, the components of the drill string are also subjected to wear and abrasion from drilling mud, as well as the vibration of the drill string.

The distal end of a drill string, which includes the drill bit, is referred to as the "bottom hole assembly." In "measurement while drilling" (MWD) applications, sensing modules in the bottom hole assembly provide information concerning the direction of the drilling. This information can be used, for example, to control the direction in which the drill bit advances in a steerable drill string. Such sensors may include a magnetometer to sense azimuth and accelerometers to sense inclination and tool face.

Historically, information concerning the conditions in the well, such as information about the formation being drill through, was obtained by stopping drilling, removing the drill string, and lowering sensors into the bore using a wire line cable, which were then retrieved after the measurements had been taken. This approach was known as wire line logging. More recently, sensing modules have been incorporated into the bottom hole assembly to provide the drill operator with essentially real time information concerning one or more aspects of the drilling operation as the drilling progresses. In "logging while drilling" (LWD) applications, the drilling aspects about which information is supplied comprise characteristics of the formation being drilled through. For example, resistivity sensors may be used to transmit, and then receive, high frequency wavelength signals (e.g., electromagnetic waves) that travel through the formation surrounding the sensor. By comparing the transmitted and received signals, information can be determined concerning the nature of the formation through which the signal traveled, such as whether it contains water or hydrocarbons. Other sensors are used in conjunction with magnetic resonance imaging (MRI). Still other sensors include gamma scintillators, which are used to determine the natural radioactivity of the formation, and nuclear detectors, which are used to determine the porosity and density of the formation.

In both LWD and MWD systems, the information collected by the sensors must be transmitted to the surface, where it can be analyzed. Such data transmission is typically accomplished using a technique referred to as "mud pulse telemetry." In a mud pulse telemetry system, signals from the sensor modules are typically received and processed in a microprocessor-based data encoder of the bottom hole assembly, which digitally encodes the sensor data. A controller in the control module then actuates a pulser, also incorporated into the bottom hole assembly, that generates pressure pulses within the flow of drilling mud that contain the encoded information. The pressure pulses are defined by a variety of characteristics, including amplitude (the difference between the maximum and minimum values of the pressure), duration (the time interval during which the pressure is increased), shape, and frequency (the number of pulses per unit time). Various encoding systems have been developed using one or more pressure pulse characteristics to represent binary data (i.e., bit 1 or 0)—for example, a pressure pulse of 0.5 second duration represents binary 1, while a pressure pulse of 1.0 second duration represents binary 0. Transmitting information via pressure pulses, including schemes for encoding pressure pulses, are described in U.S. Published Application No. 2006/0215491 (Hall), hereby incorporated by reference in its entirety. The pressure pulses travel up the column of drilling mud flowing down to the drill bit, where they are sensed by a strain gage based pressure transducer. The data from the pressure transducers are then decoded and analyzed by the drill rig operating personnel.

Various techniques have been attempted for generating the pressure pulses in the drilling mud. One technique involves incorporating a pulser into the drill string in which the drilling mud flows through passages formed by a stator. In one type of pulser, referred to as a mud siren, a rotor, which is typically disposed adjacent the stator, is rotated continuously, thereby generating pulses in the drilling fluid. In another type of pulser, the rotor is oscillated or rotated incrementally in one direction, so that the rotor blades alternately increase and decrease the amount by which they obstruct the stator passages, thereby generating pulses in the drilling fluid. An oscillating type pulser is disclosed in U.S. Pat. No. 6,714,138 (Turner et al.) and U.S. Pat. No. 7,327,634 (Perry et al.), each of which is hereby incorporated by reference in its entirety.

Unfortunately, such rotary pulsers have limited flexibility in terms of their ability to vary their operating mode as drilling conditions change or the quantity or type of data to be transmitted changes. For example, while continuous rotation in a mud siren mode might be optimal in some situations, oscillatory rotation might be optimal in other situations. Different operating modes might be needed if the pulser jambs and/or debris has to be cleared frequently. The ability to change data transmission wavelength in a siren may move the data band to a frequency where there is less noise.

Further, such rotary pulsers are prone to plugging. In order to ensure that oil and gas in the formation do not enter the borehole during drilling (which is environmentally undesirable), the pressure of drilling mud in the borehole is kept high. However, this can cause the drilling mud to flow into the formation at a rate that is greater than the rate at which the mud is pumped down into the hole. As a result, no mud returns to the surface, a condition referred to as lost circulation. When circulation of drilling mud is lost, drilling chips and debris from the formation are not flushed away from the drill bit. To prevent the loss of drilling mud, various types of debris and trash—referred to as lost circulation material—are pumped down the drill string along with the drilling mud so that the debris will plug the passages in the formation and prevent the loss of drilling mud. However, this lost circulation material can plug the passages in the stator of the pulser. Further, long strands of lost circulation material can become wrapped around the pulser's rotor, essentially plugging the passages between rotor blades, especially if the rotor is rotated continuously in one direction.

SUMMARY

It would be desirable to provide a mud pulse telemetry system and a pulser in which the operating mode of the pulser could be varied to allow higher amplitude pulse signals to be generated downhole and observed at the surface. In addition, it would be desirable to have a pulser that is less prone to plugging than traditional continuous or oscillating pulsers.

In one embodiment, the invention comprises a pulser for transmitting, to a location proximate the surface of the earth, information from a portion of a drill string operating at a down hole location in a well bore. The drill string has a passage in which a pulser is adapted to be mounted and through which a drilling fluid flows. The pulser comprises a first rotor with a first passage through which the drilling fluid can flow and a first motor coupled to the first rotor so as to drive rotation of the first rotor. The pulser includes a second rotor a second passage through which the drilling fluid can flow and a second motor coupled to the second rotor so as to drive rotation of the second rotor. The second motor is independently controlled from the first rotor. The second rotor is disposed adjacent the first rotor so that each of the rotors can be rotated so as to at least partially block at least one passage in the other of the rotors, whereby rotation of one or both of the rotors relative to the other rotor creates pressure pulses in the drilling fluid.

DETAILED DESCRIPTION OF ILLUSTRATIVE EMBODIMENTS

Embodiments of the present disclosure include a dual rotor pulser configured to transmit information along a drill string through a drilling fluid during a drilling operation where a bore is formed in an earthen formation. Dual rotor pulsers as described herein may include at least two rotors which are rotatable with respect to other and/or a stator to create pressure pulses in the drilling fluid. As such, at least two rotors may be used with or without stators to generate pressure pulses. The dual rotor pulsers as described herein may form part of a mud-pulse telemetry of a drilling system 1.

Figure 1:
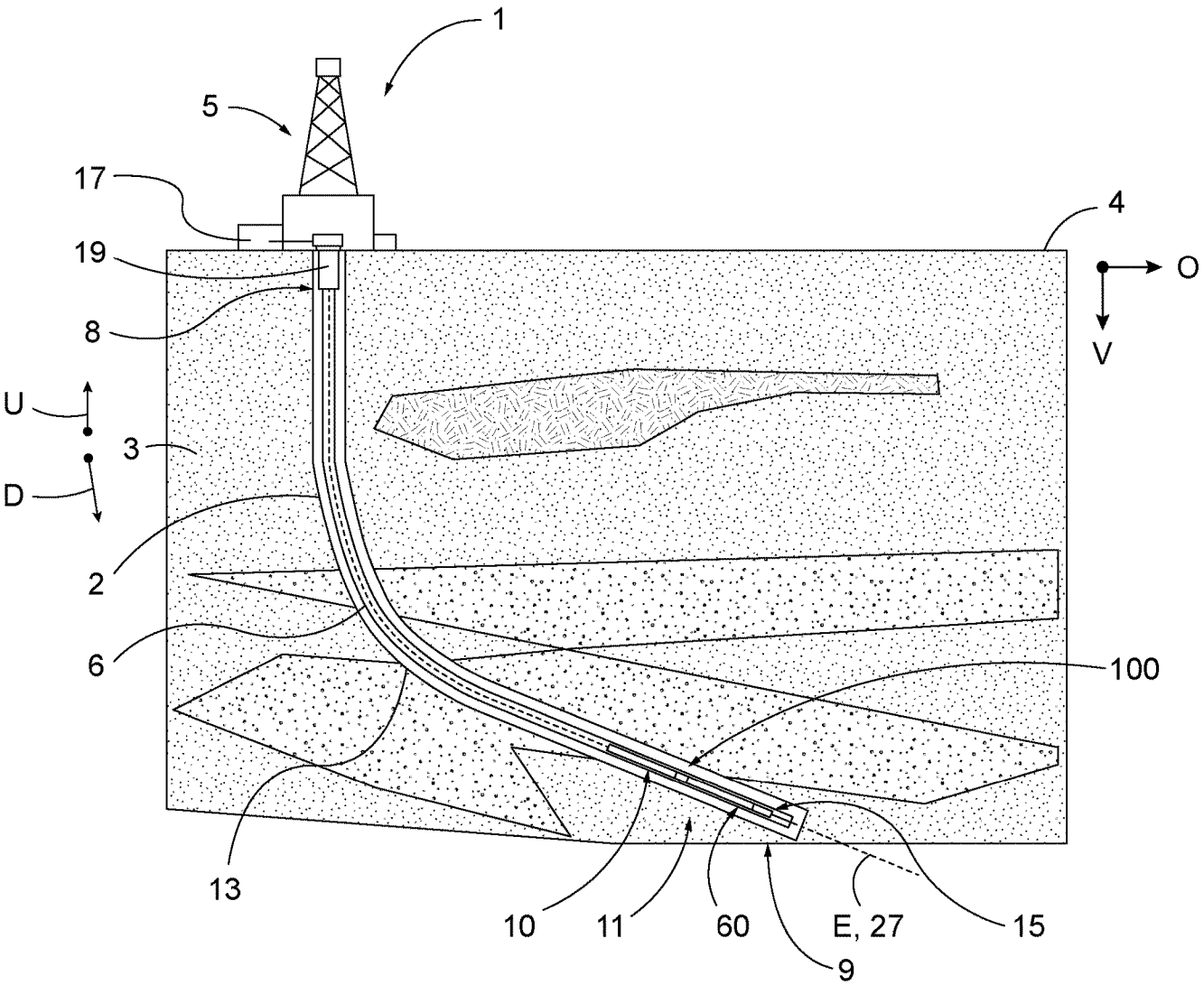
FIG. 1 is a side schematic diagram of a drilling system including a dual rotor pulser according to an embodiment of the present disclosure.

Referring to FIG. 1, a drilling system 1 includes a rig or derrick 5 that supports a drill string 6. The drill string 6 includes a bottomhole (BHA) assembly 11 coupled to a drill bit 15. The drill bit 15 is configured to drill a borehole or well 2 into the earthen formation 3 along a vertical direction V and an offset direction O that is offset from or deviated from the vertical direction V. The drilling system 1 can include a surface motor (not shown) located at the surface 4 that applies torque to the drill string 6 via a rotary table or top drive (not shown), and a downhole motor (not shown) disposed along the drill string 6 that is operably coupled to the drill bit 15. The drilling system 1 is configured to operate in a rotary steering mode, where the drill string 6 and the drill bit 15 rotate, or a sliding mode where the drill string 6 does not rotate but the drill bit does. Operation of the downhole motor causes the drill bit 15 to rotate along with or without rotation of the drill string 6. Accordingly, both the surface motor and the downhole motor can operate during the drilling operation to define the well 2. During the drilling operation, a pump 17 pumps drilling fluid downhole through an internal passage 180 (see FIG. 7) of the drill string 6 out of the drill bit 15 and back to the surface 4 through an annular passage 13 defined between the drill string 6 and well wall. The drilling system 1 can include a casing 19 that extends from the surface 4 and into the well 2. The casing 19 can be used to stabilize the formation near the surface. One or more blowout preventers can be disposed at the surface 4 at or near the casing 19.

Continuing with FIG. 1, the drill string 6 is elongate along a longitudinal central axis 27 that is aligned with a well axis E. The drill string 6 further includes an upstream end 8 and a downstream end 9 spaced from the upstream end 8 along the longitudinal central axis 27. A downhole or downstream direction D refers to a direction from the surface 4 toward the downstream end 9 of the drill string 6. Uphole or upstream direction U is opposite to the downhole direction D. Thus, "downhole" and "downstream" refers to a location that is closer to the drill string downstream end 9 than the surface 4, relative to a point of reference. "Uphole" and "upstream" refers to a location that is closer to the surface 4 than the drill sting downstream end 9, relative to a point of reference. The drilling system 1 can include one or more telemetry systems 100, one or more computing devices 200, and one or more downhole tools used to obtain data concerning the drilling operation during drilling. The telemetry system 100 facilitates communication among the surface control system components and downhole control system. For instance, in a drilling operation, the drill bit 15 drills a bore hole into an earthen formation. A mud pump pumps drilling fluid downward through the drill string 6 and into the drill bit 15. The drilling fluid flows upward to the surface through the annular passage 13 between the bore hole and the drill string 6, where, after cleaning, it is recirculated back down the drill string 6 by the mud pump. As is also conventional in MWD and LWD systems, sensors, such as those of the types discussed above, are located in the bottom hole assembly portion of the drill string. The pulser 10 located in the drill collar of the bottom hole assembly 11 so that drilling fluid flows through the pulser 10. By generating encoded pressure pulses, the pulser transmits information, such as information from the sensors, to the surface.

Figure 2:
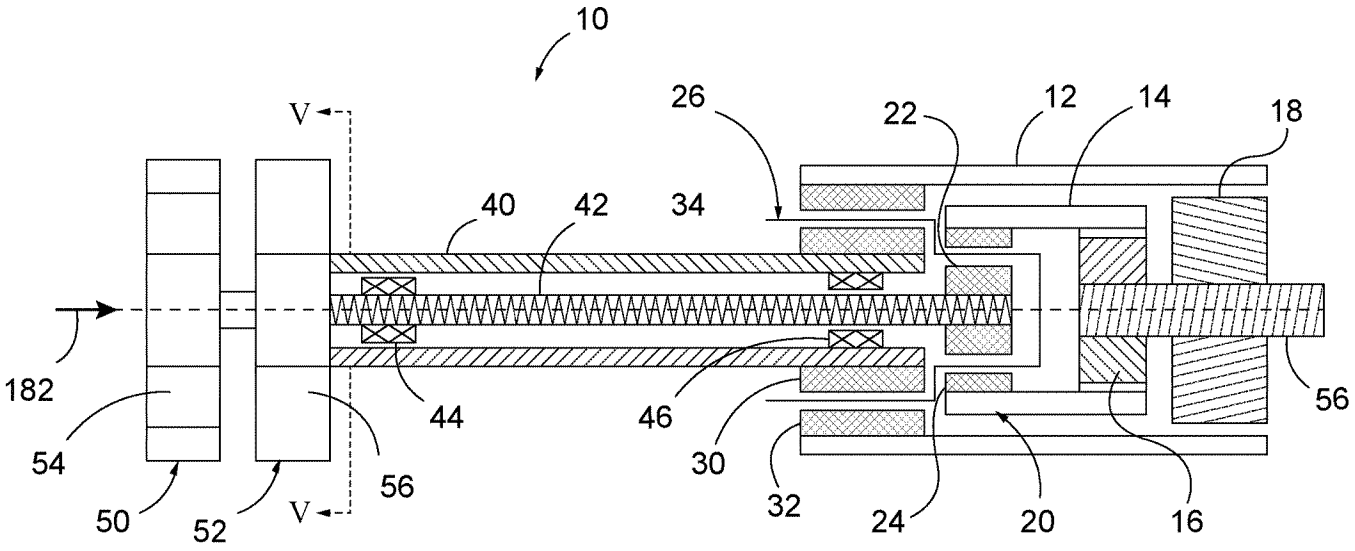
FIG. 2 is a schematic diagram of a dual rotor pulser according to an embodiment.

FIG. 2 illustrates a dual rotor pulser 10 according to an embodiment of the present disclosure. The dual rotor pulser may include an outer housing assembly (not shown in FIG. 2) which is mounted to the drill collar or a second of drill pipe. In some embodiments, the outer housing assembly may be a portion of the drill collar or drill pipe. The pulser 10 has first and second motors 16 and 18, respectively, mounted on a shaft 56. The motors 16 and 18 are preferably brushed reversible DC motors supplied with power from a power source, such as a battery or a turbine alternator driven by the flow of drilling fluid. The first motor 16 drives a rotatable inner housing 14. The inner housing 14 drives an inner shaft 42 via a first magnetic coupling 20. An inner portion 22 of the magnetic coupling 20 is mounted on the inner shaft 42 and disposed radially inboard of a pressure housing 26, while an outer portion 24 is mounted on the inner housing 14 and disposed radially outboard of the pressure housing. This allows the magnetic coupling 26 to transmit torque across the pressure housing 26. As discussed in U.S. Pat. No. 6,714,138 (Turner et al.) and U.S. Pat. No. 7,327,634 (Perry et al.), incorporated by reference above and providing mechanical details concerning the construction of a pulser, on one side of the pressure housing 26 is a gas-filled chamber in which the motors 16 and 18 are located, whereas an oil-filed chamber is formed on the other side of the pressure housing. The inner shaft 42 is supported on bearings 44 and 46 and drives rotation of a first rotor 50.

Figure 3B:
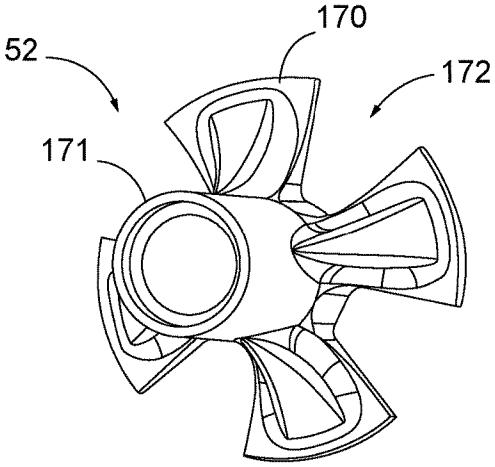
FIG. 3B is a perspective view of a second pulser rotor.
Figure 3A:
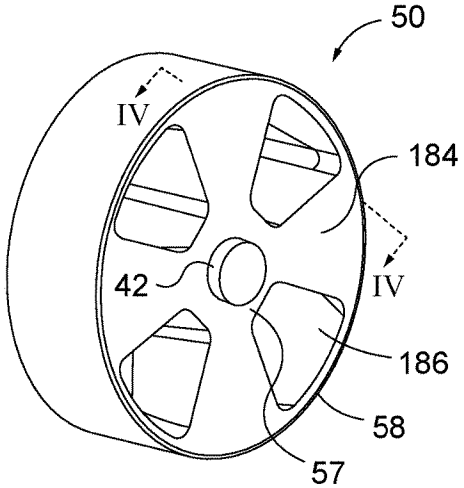
FIG. 3A is a perspective view of a first pulser rotor.
Figure 4:
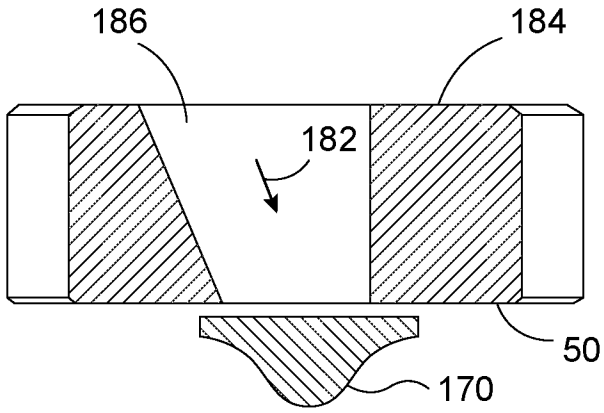
FIG. 4 is a cross sectional view through the second pulser rotor taken through line IV-IV shown in FIG. 3.

As shown in FIGS. 3 and 4, according to one embodiment of the invention, the first rotor 50 comprises a hub 57 mounted on the inner shaft 42 and a rim 58. A series of blades 184 extending between the hub 57 and the rim 58 form generally axially extending passages 186 therebetween through which the drilling mud 182 flows. As shown in FIG. 4, at least one of the walls of the passages 186 may, but need not, be oriented at an angle to the axial direction so as to impart swirl to the flow of drilling fluid 182 in additional to swirl created by the rotation of the rotor 50.

Continuing with FIG. 2, the second motor 18, which is disposed adjacent the first motor, drives a rotatable outer housing 12. The outer housing 12 drives an outer shaft 40, arranged coaxially with respect to the inner shaft 42, via a second magnetic coupling 30. An inner portion 34 of the second magnetic coupling 30 is mounted on the outer shaft 42 and disposed radially inboard of the pressure housing 26, while an outer portion 32 is mounted on the outer housing 12 and disposed radially outboard of the pressure housing. This allows the second magnetic coupling 26 to transmit torque across the pressure housing 26 to the outer shaft 40, which drives rotation of a second rotor 52.

As shown in FIG. 2, the second rotor 52 is preferably disposed immediately downstream from the first rotor 50. The second rotor 52 comprises a hub 171, which is mounted on the outer shaft 40. A plurality of rotor blades 170 extending radially outward from a hub so as to form passages 172 therebetween through which the drilling fluid 182 flows. In the illustrated embodiment, the rotors 50 and 52 have radially extending blades that form passages therebetween. In alternative embodiments of the present disclosure, other types of rotors in which a portion of one rotor was capable of at least partially blocking the flow of drilling fluid through the other rotor, such as rotors formed by discs in which holes were formed, may be used.

The pulsers according to an embodiment of present disclosure need not utilize a stationary stator. Specifically, the first and second rotors 50 and 52 are arranged adjacent to each other so that the blades of each rotor can at least partially, and in some cases almost fully, block the flow of drilling fluid through the passages in the adjacent rotor when the blades are circumferentially aligned with the passages. Furthermore, the pulser 10 could include at least two rotors that are similar to each other. For instance, the first and second rotor could be similar to rotor 50 illustrated in FIG. 3A. In another embodiment, the first and second rotors can be configured similar to rotor 52 illustrated in FIG. 3B. In still the embodiment illustrated, the first rotor is similar to rotor 50 in FIG. 3A and the second rotor is similar to rotor 52 in FIG. 3B. Accordingly, a "rotor" as used throughout the present disclosure includes a rotatable structure that includes a plurality of passages through which drilling fluid can flow. A "stator" is a structure that is fixed, or held stationary, and that includes at least one passage through which drilling fluid can flow.

Figure 6:
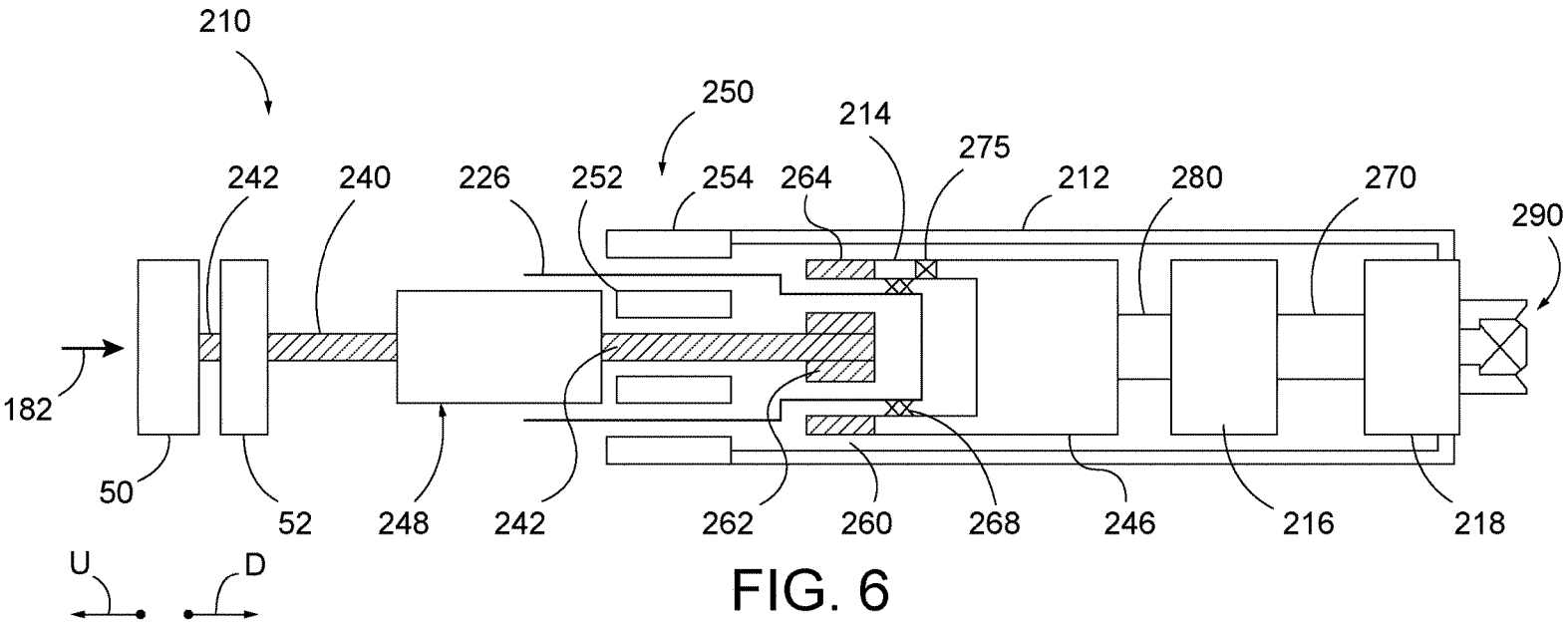
FIG. 6 is a schematic diagram of another embodiment of a dual rotor pulser according to an embodiment.

The first and second motors 16 and 18 are separately controlled by a controller, such as by the controller (not shown) shown in FIG. 6, so that the two rotors 50 and 52 need not be rotated in the same manner. Based on the digital code from a data encoder, the controller directs control signals to drivers for the motors 16 and 18. In a preferred embodiment, the motor driver receives power from the power source and directs power to a switching device. The switching device transmits power to the appropriate windings of the motors so as to effect rotation of the rotors in either a first (e.g., clockwise) or opposite (e.g., counterclockwise) direction so as to generate pressure pulses that are transmitted through the drilling mud. The pressure pulses are sensed by a sensor at the surface and the information is decoded and directed to a data acquisition system for further processing, as is conventional.

Figure 5A:
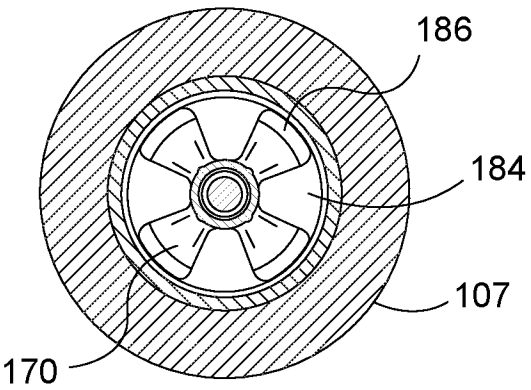
FIG. 5A is a cross-sectional view of the pulser taken along line V-V shown in FIG. 2 with the rotors in a maximum obstruction configuration.
Figure 5B:
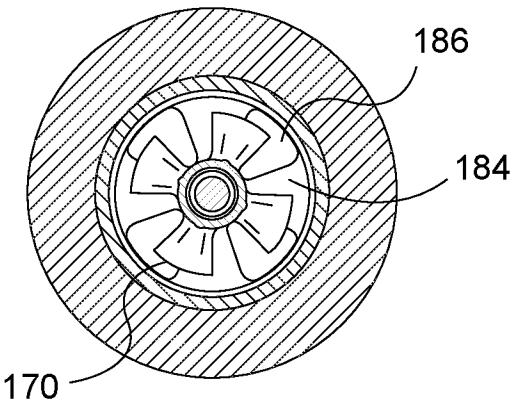
FIG. 5B is a cross-sectional view of the pulser taken along line V-V shown in FIG. 2 with the rotors in an intermediate obstruction configuration.
Figure 5C:
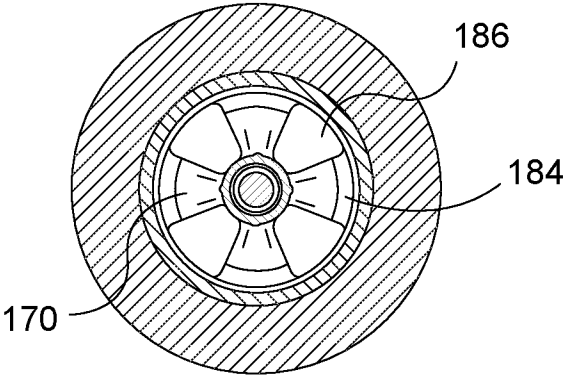
FIG. 5C is a cross-sectional view of the pulser taken along line V-V shown in FIG. 2 with the rotors in a minimum obstruction configuration.

According to an embodiment, a pressure pulse is created in the drilling fluid whenever the one or both of the rotors rotate from a relative circumferential orientation in which the rotor blades of one rotor are not aligned with the passages in the other rotor and, therefore, do not obstruct the passages in the other rotor as shown in FIG. 5C, or are only partially aligned with the passages as shown in FIG. 5B, to a circumferential orientation in which the blades are fully aligned with the passages in the other rotor as shown in FIG. 4 and FIG. 5A so as to provide the maximum obstruction to the flow of drilling fluid. A pressure pulse is also created in the drilling fluid whenever the blades of one rotor rotate from a circumferential orientation in which they are partially aligned with the passages of the other rotor and, therefore, partially obstruct the flow of drilling fluid as shown in FIG. 5B, to a circumferential orientation in which the blades are not aligned with the passages in the other rotor as shown in FIG. 5C.

The rotary pulser as described herein provides flexibility in terms of the operating mode of the pulser. In operation, one or both of the rotors 50 and 52 can be rotated continuously in the same or opposite directions, or both of the rotors can be oscillated, or one of the rotors can oscillate while the other rotates continuously in one direction. Further, one rotor can be rotated while the other rotor remains stationary, so that the stationary rotor acts as a stator. Alternatively, one rotor can be operated at a constant rotary speed, thereby generating a carrier wave within the drilling fluid, while the other rotor can rotate at a different constant rotary speed in the same direction so as to impart a phase shift in the carrier wave that is used to transmit information. In general, the rotors can be rotated in the same direction or in opposite directions. The pulser has one or more clearing operating modes when debris jams or plugs the pulser 10 such that one or both rotors 50 and 52 can be rotated as necessary to clear the debris. For example, one clearing operating mode is where one rotor rotates in a first direction while the other rotor remains stationary. In another example of a clearing operating mode is where a first rotor rotates in a first direction while the second rotor rotates in a second direction that is opposite to the first direction. In yet another example of a clearing operating mode, the first rotor remains stationary and the second rotor rotates.

The pulser 10 may include a control system (not shown) used to control operation of the pulser. The control system includes at least one controller and at least one position sensor. The controller may include one or more processors, a memory, and a communications link. The position sensor (s) may be mounted in air, compensated oil, or drilling mud environment within the downhole tool. In the embodiment shown in FIG. 6, for example, the position sensor 275 is mounted on the inner housing 214. There may be a position sensor associated with each rotor so that each position sensor can determine the rotational position of the rotors. The sensor data obtained from the position sensors can be transmitted to the controller. The controller, in turn, can initiate an operating mode based on the position of the sensors and/or instructions from the rig operator or instructions stored in the controller. However, in alternative embodiments, the position of the rotors can be determined by monitoring the pressure wave generated by rotor motion. The control system described in this paragraph may be implemented in each of the other embodiments of the dual rotor pulsers described further below.

Another embodiment of a pulser 210 is shown in FIG. 6. In this embodiment, a first motor 216, mounted on a shaft 270, drives a first reduction gear 246 via shaft 280. The reduction gear drives a rotatable inner housing 214 supported on bearings 268. The inner housing 214 drives an inner shaft 242 via a first magnetic coupling 260. An inner portion 262 of the magnetic coupling 260 is mounted on the inner shaft 242 and disposed radially inboard of a pressure housing 226, while an outer portion 264 is mounted on the inner housing 214 and disposed radially outboard of the pressure housing. This allows the magnetic coupling 260 to transmit torque across the pressure housing 226. The inner shaft 242 drives rotation of the first rotor 50. In the embodiment shown in FIG. 6, the position sensor 275 is mounted to the inner housing.

Continuing with FIG. 6, a second motor 218 drives a rotatable outer housing 212. The outer housing 212 drives a second reduction gear 248 via a second magnetic coupling 250. An inner portion 252 of the second magnetic coupling 250 is mounted on the second reduction gear 248 and is disposed radially inboard of the pressure housing 226, while an outer portion 254 is disposed radially outboard of the pressure housing. This allows the second magnetic coupling 250 to transmit torque across the pressure housing 226 to the second reduction gear 248, which drives rotation of an outer shaft 240. The outer shaft 240 drives rotation of the second rotor 52. Element 290 includes is point of fixity where by shafts of the first and second motors are fixed.

Figure 7:
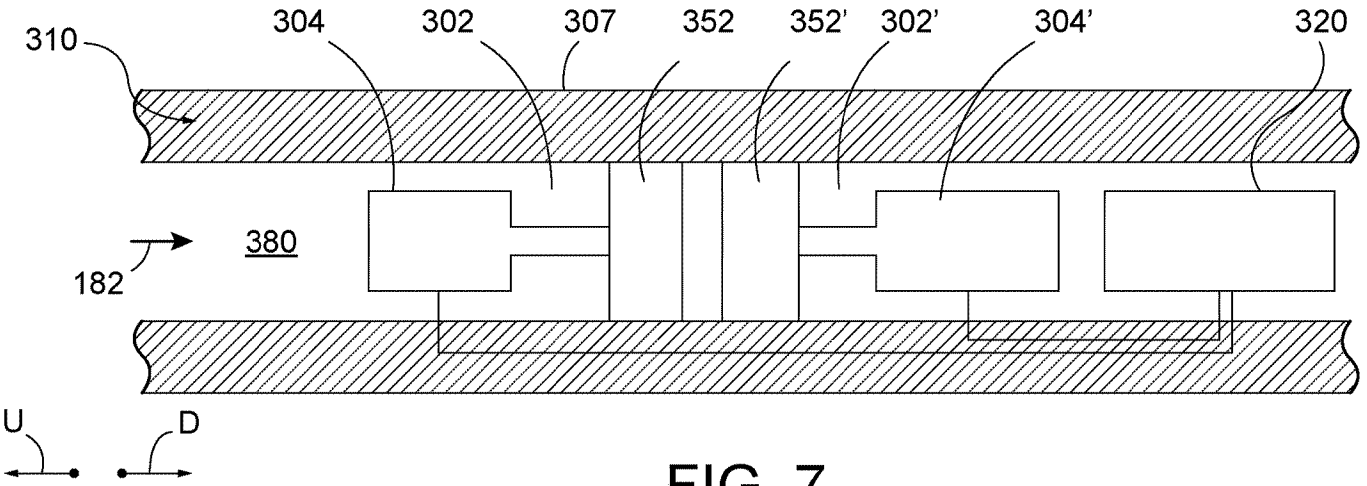
FIG. 7 is a schematic diagram of another dual rotor pulser according to an embodiment.
Figure 8:
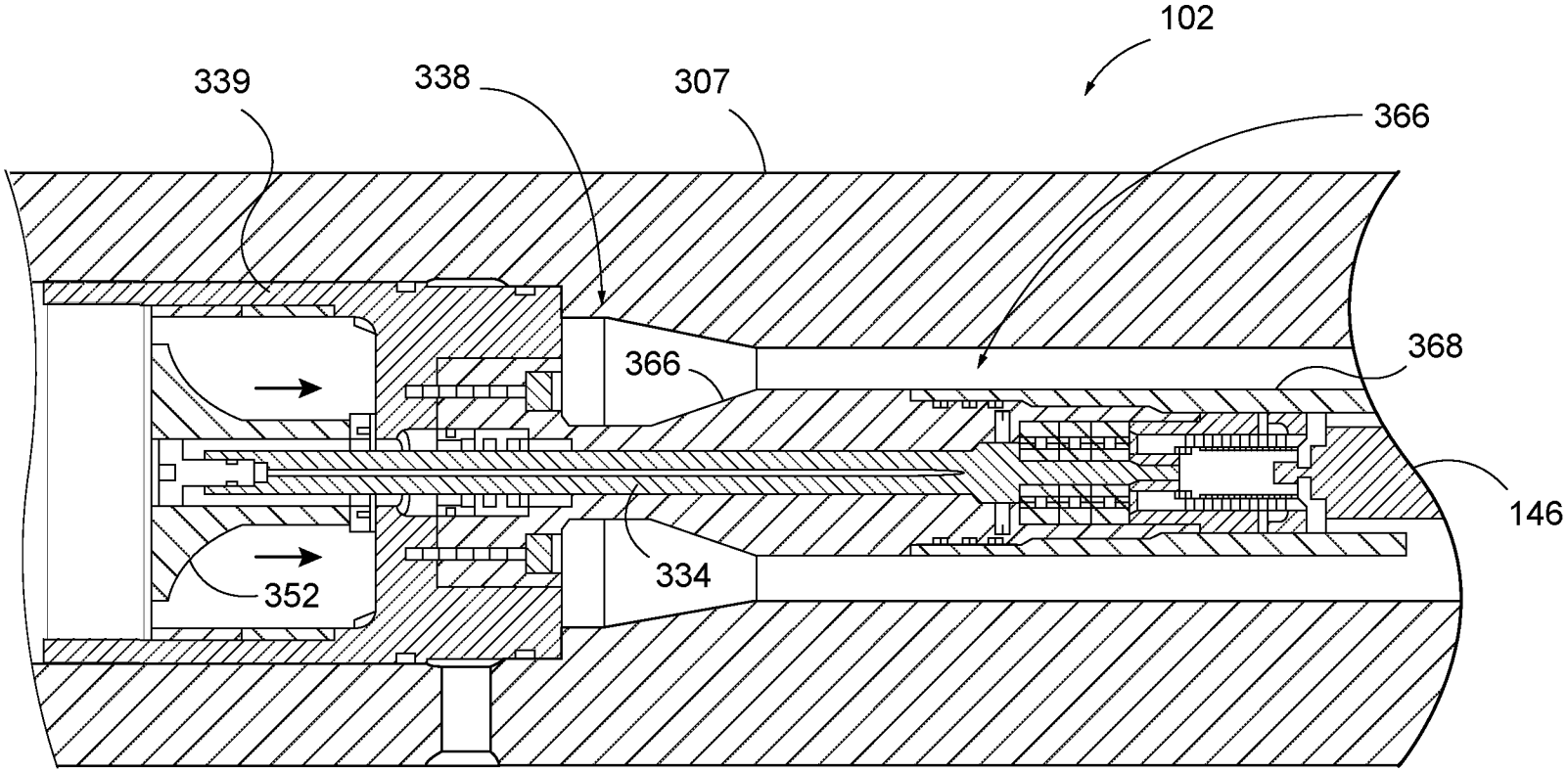
FIG. 8 is a longitudinal cross-section through a portion of the downstream pulser half of the dual rotor pulser shown in FIG. 7.

Another embodiment of a pulser 310 is shown in FIGS. 7 and 8. In this embodiment, the pulser 310 comprises two pulser portions 302 and 302', which may be identical. The pulser portions 302 and 302' are mounted in passage 180 (not shown) formed within the drill collar 307, and through which the drilling fluid 182 flows, so that their rotors 352 and 352' are adjacent each other. Whereas in the embodiments discussed above, both motors were disposed on the same side, relative to the direction of flow of the drilling fluid, of the rotors 352 and 352', in the embodiment shown in FIGS. 7 and 8, the motors 304 and 304' are disposed on opposite sides of the rotors 352 and 352'. A controller 320 separately controls the motors 304 and 304'. As shown in FIG. 7, each pulser portion comprises a rotor 352 mounted within an outer housing assembly 338. The outer housing assembly 338 is mounted within the drill collar 307 or section of drill pipe. The outer housing assembly 338 may include an annular shroud housing 339, a first housing 366 and a second housing 368. The rotor 352 is driven by a shaft 334, which is driven by a reduction gear 346. An electric motor (not shown in FIG. 7) drives the reduction gear 346. As previously discussed, rotation of one rotor relative to the other rotor generates pressure pulses within the drilling fluid without the need for a stationary stator. Rotation of the rotors also allows debris to be cleared from the pulser.

Figure 9:
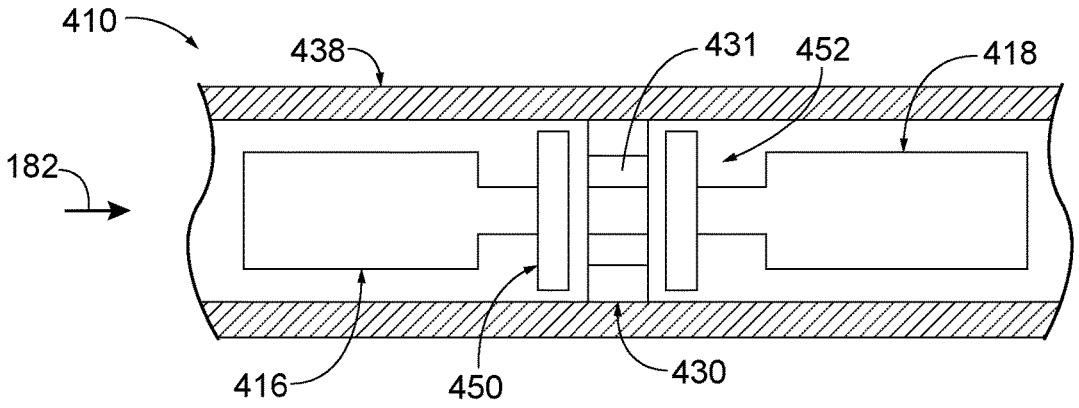
FIG. 9 is a schematic diagram a dual rotor pulser according to another embodiment.

Another embodiment of a pulser 410 is shown in FIG. 9. As illustrated in FIG. 9, the pulser includes an outer housing assembly 438 for mounting in a passage 180 (not shown) of the drill string. A stator 430 is mounted to the outer housing assembly 438. The stator 430 includes at least one stator passage 431 through which the drilling fluid can flow. The pulser 410 also includes a first rotor 450 that includes a first passage through which the drilling fluid 182 can flow, and a first motor 416 coupled to the first rotor 450 so as to drive rotation of the first rotor 450. The pulser 410 includes a second rotor 452 having a second passage through which the drilling fluid 182 can flow, and a second motor 418 to drive rotation of the second rotor 452. In the embodiment shown in FIG. 9, the stator 430 is disposed adjacent to and between the first rotor 450 and the second rotor 452. The pulser 410 can operate similar to the pulsers described above. For instance, the pulser is designed so that at least one of the first rotor 450 and the second rotor 452 are rotatable so as to at least partially block the stator passage. Thus, rotation of one or both of the first and second rotors 450, 452 relative to the stator 430 creates pressure pulses. A controller can operate the motors 416 and 418 and encode the information into the pressure pulses created by rotation of the first and second rotors. The pulser 410 may include drive shafts, couplings and other components, similar to that described above and shown in the figures with respect to pulser 10, 210 and 310.

Figure 10:
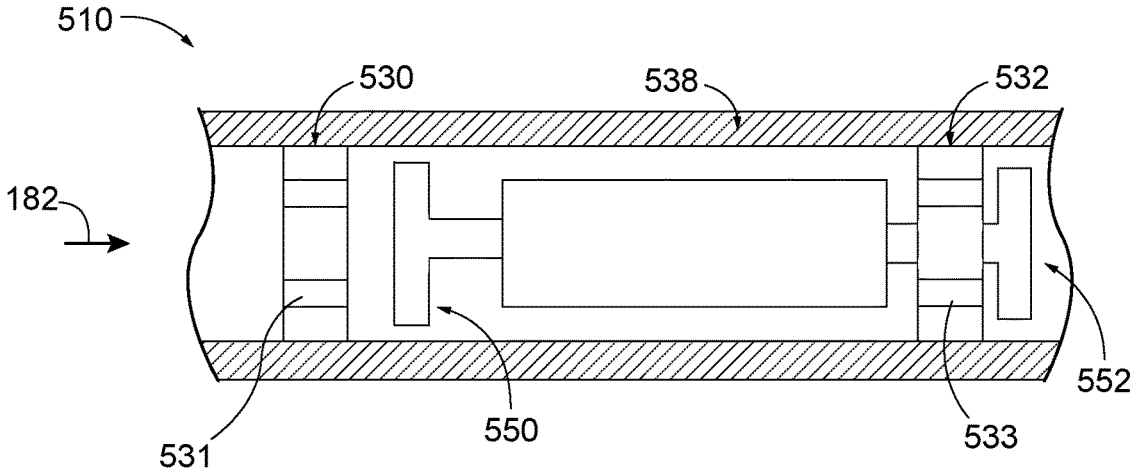
FIG. 10 is a schematic diagram of a dual rotor pulser according to another embodiment.

Another embodiment of a pulser 510 is shown in FIG. 10. The pulser 510 shown in FIG. 10 is also configured to transmit information from a location downhole toward a location proximate the surface of the earthen formation. The pulser 510 includes an outer housing assembly 538 for mounting in a passage of the drill string. The outer housing assembly 538 may form part of the drill string or it may be separate component attached to the drill string. A first stator 530 is mounted to the outer housing assembly 538. The first stator 530 includes a first stator passage 531 through which drilling fluid can flow. A first rotor 550 is positioned adjacent to the first stator 530. The first rotor 550 includes a first passage (not shown) through which the drilling fluid 182 can flow. The first rotor 550 is rotatable with respect to the first stator 530 and the outer housing assembly 538 to at least partially block the first stator passage 531.

Continuing with FIG. 10, the pulser 510 includes a second stator 532 mounted to the outer housing assembly 538. The second stator 532 includes a second stator passage 533 through which drilling fluid 182 can flow. A second rotor 552 is positioned adjacent to the second stator 532. The second rotor includes a second passage through which the drilling fluid can flow. The second rotor is also rotatable with respect to second stator 532 and the outer housing assembly 538 to at least partially block the second stator passage 533. The pulser 510 also includes a motor assembly 516 may be coupled to the first rotor 550 and the second rotor 552 to drive rotation of the first rotor 550 and the second rotor 552. In operation, rotation of the first rotor 550 relative to the first stator 530 creates first pressure pulses in the drilling fluid 182 when the drilling fluid is flowing through the first passage and the first stator passage 531. Furthermore, rotation of the second rotor 552 relative to the second stator 532 creates second pressure pulses in the drilling fluid 182 when the drilling fluid is flowing through the second passage and the second stator passage 533. Rotation of the rotors according to control signal from a controller also encode the information in the first and second pressure pulses. The pulser 510 may include drive shafts, couplings and other components, similar to that described above and shown in the figures with respect to pulser 10, 210 and 310.

Figure 11:
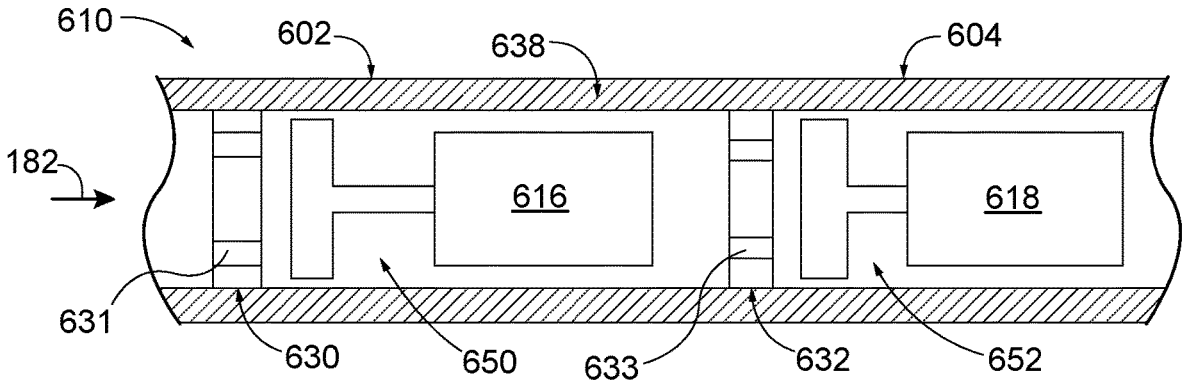
FIG. 11 is a schematic diagram of a dual rotor pulser according to another embodiment.

Another embodiment of a pulser 610 is shown in FIG. 11. The pulser 610 is configured to transmit information through the drilling fluid, similar to embodiments described above. In the pulser 610 includes dual pulser portions 602 and 604, one of which is disposed downhole with respect to the other. The pulser 610 includes an outer housing assembly 638 for mounting in a passage of the drill string. The outer housing assembly 638 may form part of the drill string, such as a portion of the drill collar or drill pipe. Alternatively, the outer housing assembly 638 may be attached to the drill string. The dual pulser portions may be a first pulser portion 602 and a second pulser portion 604 that is similar to, and is mounted downhole with respect to, the first pulser portion 602. The first pulser portion 602 includes a first rotor 650, a first stator 630, and a first motor 616. The first stator 630 may be mounted to the outer housing assembly 638. The first stator 630 may also include a first stator passage 631 through which drilling fluid 182 can flow. The first rotor 650 is adjacent to the first stator 630 and also includes a first passage through which the drilling fluid can flow. The first rotor 650 is rotatable with respect to the first stator 630 and the outer housing assembly 638 to at least partially block the first stator passage 631.

Continuing with FIG. 11, the second pulser portion 604 includes a second rotor 652, a second stator 632, and a second motor 618. The second stator 632 may be mounted to the outer housing assembly 638. The second stator 632 may also include a second stator passage 633 through which drilling fluid 182 can flow. The second rotor 652 is adjacent to the second stator 632 and also includes a second passage through which the drilling fluid can flow. The second rotor 652 is rotatable with respect to the second stator 632 and the outer housing assembly 638 to at least partially block the first stator passage 633. The pulser 610 may include drive shafts, couplings and other components, similar to that described above and shown in the figures with respect to pulser 10, 210 and 310. In operation, rotation of the first rotor 650 relative to the first stator 630 creates first pressure pulses in the drilling fluid when the drilling fluid is flowing through the first passage and the first stator passage. Furthermore, rotation of the second rotor 652 relative to the second stator 632 creates second pressure pulses in the drilling fluid when the drilling fluid is flowing through the second passage and the second stator passage. Rotation of the rotors according to control signal from a controller also encode the information in the first and second pressure pulses.

The embodiments of each pulser 10, 210, 310, 410, 510 and 610 each include a control system that controls operation of the pulser. The control system includes a controller that operates the motors (or motor assembly) to cause rotation of the first and second rotors, one or more position sensors, a power source. The controller may include one or more processors, a memory, and a communications link that can be used to transmit control signals to the motors (or motor assembly). A variety of operation modes may be used to control rotor operation. In one example, the controller is configured to operate the first and second motors so as to selectively rotate one of the first motor and the second motor while inhibiting rotation of the other of the first motor and the second motor. This may be useful in cleaning modes to remove debris. In another example, the controller is configured to cause the first motor and the second motor to continuously rotate the first rotor and the second rotor, respectively, in a similar rotational direction. In other words, the first rotor and the second rotor both rotate counterclockwise (or clockwise). In this case, the controller can cause the motor (or motor assembly) to rotate at different rotational speeds. This mode of operation may be used to adjust the data signal, in particular, the waveform of the created pressure pulsers may be adjusted. In an alternative embodiment, the controller can be set to continuously rotate the first rotor and second rotor, respectively, in different rotational directions. For example, the first rotor may rotate clockwise and the second rotor may rotate counter clockwise (or vice versa). In yet another example, the controller may be configured to the motors (or motor assembly) to oscillate the first rotor and second rotors. Furthermore, the controller may be configured to oscillate the first and second rotors at different oscillation speeds.

It should be appreciated that each pulser of the present disclosure may utilize a number of different rotor configurations. For instance, the pulsers with adjacent rotors may utilize rotors that are similar to each other. For instance, the first and second rotor could be similar to rotor 50 illustrated in FIG. 3A. In another embodiment, the first and second rotors can be configured similar to rotor 52 illustrated in FIG. 3B. In still another embodiment, the first rotor is similar to rotor 50 in FIG. 3A and the second rotor is similar to rotor 52 in FIG. 3B.

In another embodiment, a method of transmitting information from a portion of a drill string operating at a down hole location in a well bore to a location proximate the surface of the earth may use one or more of pulsers as described herein. The pulser may include at least first and second rotors. The method includes flowing drilling fluid through the drill string passage. The method may also include rotating the first and second rotors so that each of the rotors at least partially blocks the passage in the other of the rotors so as to create pressure pulses in the drilling fluid. The rotation of rotors is selected to encode information into the pressure pulsers being transmitted to the surface through the drilling fluid.

Typical rotary pulsers have drawbacks and the dual rotor pulsers as described in the present disclosure may address those drawbacks. For example, conventional rotary pulsers have limited flexibility in terms of their ability to vary their operating mode as drilling conditions change or the quantity or type of data to be transmitted changes. For example, while continuous rotation in a mud siren mode might be optimal in some situations, oscillatory rotation might be optimal in other situations. Different operating modes might be needed if the pulser jambs and/or debris has to be cleared frequently. The ability to change data transmission wavelength in a siren may move the data band to a frequency where there is less noise. It would be desirable to provide a mud-pulse telemetry system and a dual rotor pulser in which the operating mode of the pulser could be varied to allow higher amplitude pulse signals to be generated downhole and observed at the surface. In addition, the dual rotor pulsers have a number of different operating modes that allow the operator (or control system) to adjust or change the data transmission wavelength during the drilling operation.

Furthermore, typical rotary pulsers are prone to plugging. In order to ensure that oil and gas in the formation do not enter the borehole during drilling (which is environmentally undesirable), the pressure of drilling mud in borehole is kept high. However, this can cause the drilling mud to flow into the formation at a rate that is greater than the rate at which the mud is pumped down into the hole. As a result, no mud returns to the surface, a condition referred to as lost circulation. When circulation of drilling mud is lost, drilling chips and debris from the formation are not flushed away from the drill bit. To prevent the loss of drilling mud, various types of debris and trash—referred to as lost circulation material—are pumped down the drill string along with the drilling mud so that the debris will plug the passages in the formation and prevent the loss of drilling mud. However, this lost circulation material can plug the passages in the stator of the pulser. Further, long strands of lost circulation material can become wrapped around the pulser's rotor, essentially plugging the passages between rotor blades, especially if the rotor is rotated continuously in one direction. In addition, it would be desirable to have a pulser that is less prone to plugging than traditional continuous or oscillating pulsers. The dual rotors as described in the present disclosure have several different cleaning modes that aid in removing debris downhole. This has the advantage of avoiding to have to remove the tools to remove the debris manually. This can also improve tool reliability of and minimize the possibility of catastrophic failures.

Thus, although embodiments described above have been illustrated by reference to certain specific embodiments, those skilled in the art, armed with the foregoing disclosure, will appreciate that many variations could be employed. Therefore, it should be appreciated that the embodiment may be embodied in other specific forms without departing from the spirit or essential attributes thereof and, accordingly, reference should be made to the appended claims, rather than to the foregoing specification, as indicating the scope of the invention.

What is claimed:

1. A pulser configured to transmit information from a portion of a drill string operating at a down hole location in a well bore toward a location proximate the surface of an earthen formation, the pulser comprising:

an outer housing assembly;

a first rotor including a first passage through which the drilling fluid can flow;

a first motor coupled to the first rotor so as to drive rotation of the first rotor;

a second rotor including a second passage through which the drilling fluid can flow, the second rotor is disposed adjacent the first rotor;

a second motor coupled to the second rotor so as to drive rotation of the second rotor, the second motor being separately controlled from the first rotor; and a stator including a stator passage, the stator being fixed to the outer housing assembly between the first rotor and the second rotor, wherein the first rotor and the second rotor are rotatable to at least partially block the stator passage, such that, rotation of at least one of the first and second rotors relative to the stator creates pressure pulses in the drilling fluid when drilling fluid is flowing through the respective first and second passages and the stator passage, wherein the information is encoded in the pressure pulses.

2. The pulser according to claim 1, wherein the first and second motors are disposed on opposite sides of the stator.

3. The pulser according to claim 2, further comprising a controller configured to operate the first motor and the second motor.

4. The pulser according to claim 3, wherein the controller is configured to operate the first and second motors so as to selectively rotate one of the first motor and the second motor while inhibiting rotation of the other of the first motor and the second motor.

5. The pulser according to claim 3, wherein the controller is configured to cause the first motor and the second motor to continuously rotate the first rotor and the second rotor, respectively, in a similar rotational direction.

6. The pulser according to claim 3, wherein the controller is configured to cause the first motor and the second motor to continuously rotate the first rotor and second rotor, respectively, in different rotational directions.

7. The pulser according to claim 3, wherein the first rotor and the second rotor rotate at different rotational speeds.

8. The pulser according to claim 3, wherein the controller is configured to cause the first motor and the second motor to oscillate the first rotor and second rotor, respectively.

9. The pulser according to claim 8, wherein the first rotor and the second rotor oscillate at different speeds.

* * * * *